United States Patent [19]

Amano

[11] Patent Number: 5,031,728

[45] Date of Patent: Jul. 16, 1991

[54] GROUP SUPERVISION APPARATUS AND GROUP SUPERVISION METHOD FOR ELEVATOR SYSTEM

[75] Inventor: Masaaki Amano, Inazawa, Japan

[73] Assignee: Mitsubishi Denki Kabushiki Kaisha, Japan

[21] Appl. No.: 470,757

[22] Filed: Jan. 26, 1990

[30] Foreign Application Priority Data

Feb. 17, 1989 [JP] Japan ..... 1-37602

[51] Int. Cl.[5] ..... B66B 1/20

[52] U.S. Cl. ..... 187/124; 187/127

[58] Field of Search ..... 187/124, 101, 127, 130, 187/133; 364/554, 424.01–424.1

[56] References Cited

U.S. PATENT DOCUMENTS 4,591,985 5/1986 Tsuji ..... 364/424
4,669,579 6/1987 Ookubo ..... 187/124
4,677,577 6/1987 Takabe et al. ..... 364/554
4,685,536 8/1987 Ichioka ..... 187/101
4,719,996 1/1988 Tsuji ..... 187/127

FOREIGN PATENT DOCUMENTS 59-74872 4/1984 Japan .
60-48875 3/1985 Japan .

*Primary Examiner*—Todd E. DeBoer
*Assistant Examiner*—Charles E. Eckholdt
*Attorney, Agent, or Firm*—Leydig, Voit & Mayer

[57] ABSTRACT

A group supervision method and apparatus for an elevator system wherein information items on elevator traffic states are gathered for selected days. Each day is divided into a number of time zones that contain traffic state information. Information gathered for selected days is compared by comparing respective time zones of the selected days. Days that have traffic states of small mutual differences are grouped together as a handling unit. The traffic state information of each time zone of each day is statistically processed and the days comprising the handling unit are treated as a single unit.

6 Claims, 8 Drawing Sheets

ENTRY
ST 1
TRANS DATA TO & FROM CPU OF GR SUPV
ST 2
SET DAY-OF-WEEK OF THAT DAY OF PROC
ST 3
IS THAT DAY DAY-OF-WEEK TO BE LEARNT ?
NO
YES
ST 4
GATHER TRAF VOL OF THAT DAY
ST 5
DO NOT GATHER TRAF VOL OF THAT DAY
EXIT

FIG. 6

| DAY OF WEEK | SUN | | | | | | |
|---|---|---|---|---|---|---|---|
| MON | × | MON | | | | | |
| TUE | × | × | TUE | | | | |
| WED | × | × | ○ | WED | | | |
| THU | × | × | ○ | ○ | THU | | |
| FRI | × | × | × | × | × | FRI | |
| SAT | × | × | × | × | × | × | SAT |

PATT 1 = SUN

PATT 2 = MON

PATT 3 = TUE, WED, THU

PATT 4 = FRI

PATT 5 = SAT

○ ---- COMB. IN WHICH $C^{wk1}_{wk2}$ EXCEEDS A PREDET VAL

× ---- COMB. IN WHICH $C^{wk1}_{wk2}$ DOES NOT EXCEED THE PREDET VAL

GROUP SUPERVISION APPARATUS AND GROUP SUPERVISION METHOD FOR ELEVATOR SYSTEM

BACKGROUND OF THE INVENTION

This invention relates to improvements in a group supervision apparatus and a group supervision method for an elevator system with a learning function.

As group supervision apparatuses each controlling a plurality of cages using microcomputers, have recently experienced widespread use. It has therefore become possible to readily store past, data such as of the motions of the cages and the occurrences of hall calls over a predetermined time period.

An apparatus wherein a statistics device is provided in an elevator system so as to collect the statistics of the occurrences of passengers at respective floors in respective time zones and to group-supervise cages on the basis of the statistical results collected, is proposed in, for example, the official gazette of Japanese Patent Application Laid-open No. 22274/1983. In addition, a group supervision apparatus wherein a statistical unit to be handled is classified into three types; a workday, a holiday and a half-holiday, is proposed in the official gazette of Japanese Patent Application Laid-open No. 48875/1985.

A prior-art example wherein the statistical unit to-be-handled is classified, is shown in FIG. 8. Referring to the figure, the example includes hall buttons 21, workday traffic volume measurement means 22, holiday traffic volume measurement means 23, a timepiece 24, half-holiday traffic volume estimation means 25, cage assignment means 26, a drive control device 27 and a motor 28.

The traffic volume during the workday and during the holiday are measured from the outputs of the individual hall buttons 21. On the basis of these traffic volumes and the output of the timepiece 24, the half-holiday traffic volume estimation means 25 takes the statistics of traffic volumes in individual time zones, whereupon it estimates the traffic volume during the forenoon of the half-holiday by the use of the statistical results of the workday and the traffic volume during the afternoon by the use of the statistical results of the holiday. According to the estimated results, the case assignment means 26 controls the assignment of cages and drives the hoisting motor 28 through the drive control device 27 so as to operate the cages.

With this apparatus, an elevator system is group-supervised on the workday and the holiday by the use of the statistics of the traffic volumes of the elevator system collected as to the respective days and on the half-holiday and by the use of the statistics estimated from the measured results of both the workday and the holiday, whereby saving in the storage capacity of a computer is permitted.

However, traffic situations inside buildings differ greatly, depending upon the uses of the interiors of the buildings and upon the day of the week. In some ordinary office buildings, the traffic situations can be broadly classified into the three types of the workday (any day from Monday to Friday), the holiday (Sunday and festival days) and the half-holiday (Saturday). Even on the workdays, however, the traffic can be said to differ depending upon the days of the week, for example, a morning meeting is held on Monday, so the traffic concentrates on a certain floor at about 8:30 a.m., or there is no overtime work on Friday, so the peak of the office-leaving hour corresponding to concentrated traffic appears at a time earlier than on the other workdays. Besides, in a hotel which has a wedding hall, many marriage ceremonies are performed on a lucky day, in which case the traffic differs from that on any other day. Thus, it is understood that the traffic situation inside the building differs depending upon the days of the week and upon whether the day is thought lucky or unlucky. It is unfavorable, however, to separately collect statistics even on days whose traffic volumes are not very different from those on the other days, for the reason that a large storage capacity is required for the computer. Nevertheless, when the traffic situation is roughly classified into the workday, holiday and half-holiday types, the precision of the statistical results becomes low.

SUMMARY OF THE INVENTION

This invention has been made in order to eliminate the problems as stated above, and has for its object to provide a group supervision apparatus and method for an elevator system which can attain saving in a storage capacity and which can heighten the precision of statistics.

An elevator group supervision apparatus and method according to this invention comprise means for gathering traffic information of an elevator system for one day over a predetermined term, finding out days whose traffic states are similar to one another, and setting a unit to-be-handled in which the days have information collectively gathered and processed, whereby the traffic information items of the days are processed every such unit.

The elevator group supervision apparatus and method in this invention collectively gather and process the information items as one unit to-be-handled, regarding the days decided to have similar traffic states.

BRIEF DESCRIPTION OF THE DRAWINGS

FIG. 6 and FIGS. 7(*a*) and 7(*b*) are diagrams for explaining classification for clarifying a statistical unit to-be-handled in the embodiment of this invention.

Throughout the drawings, the same symbols indicate identical or equivalent portions.

DESCRIPTION OF THE PREFERRED EMBODIMENTS

Now, embodiments of this invention will be described with reference to the drawings.

Figure 1:
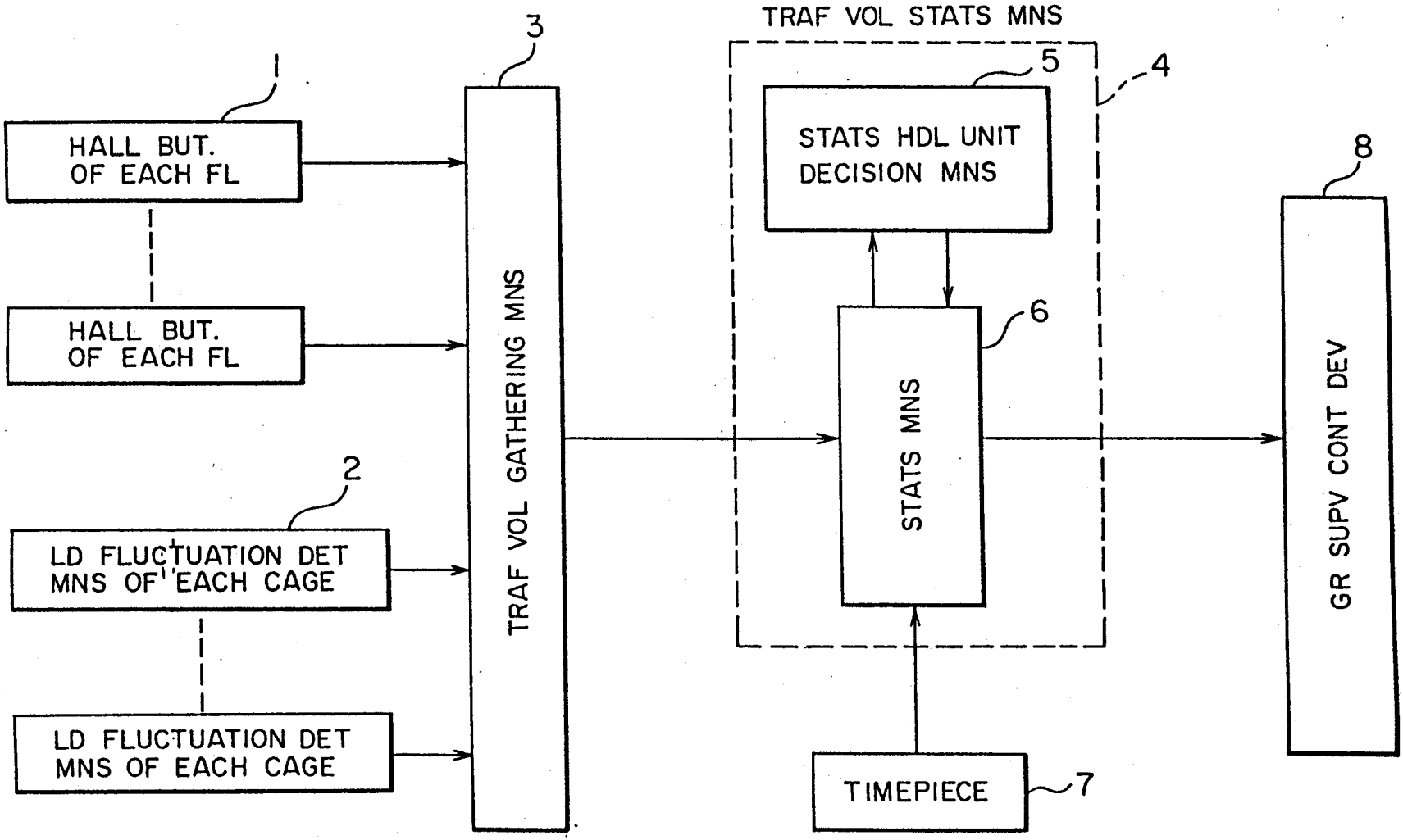
FIG. 1 is an arrangement diagram showing an embodiment of this invention.

Referring to FIG. 1, numeral 1 designates a hall button which is provided at each floor of a building, and numeral 2 designates load fluctuation detection means which is mounted on each cage of an elevator system. The outputs of the hall buttons 1 and the detection means 2 are gathered by traffic volume gathering means 3. Shown at numeral 4 is traffic volume statistics means, which is divided into statistical handling unit decision means 5 for deciding the days of the week to have their statistics taken as an identical pattern, and statistics means 6 for actually executing statistical processing. A timepiece 7 sets the days of the week and periods of time, and a group-supervisory control device 8 obtains statistical results from the statistics means 6 so as to perform the group supervision of the elevator system.

Figure 2:
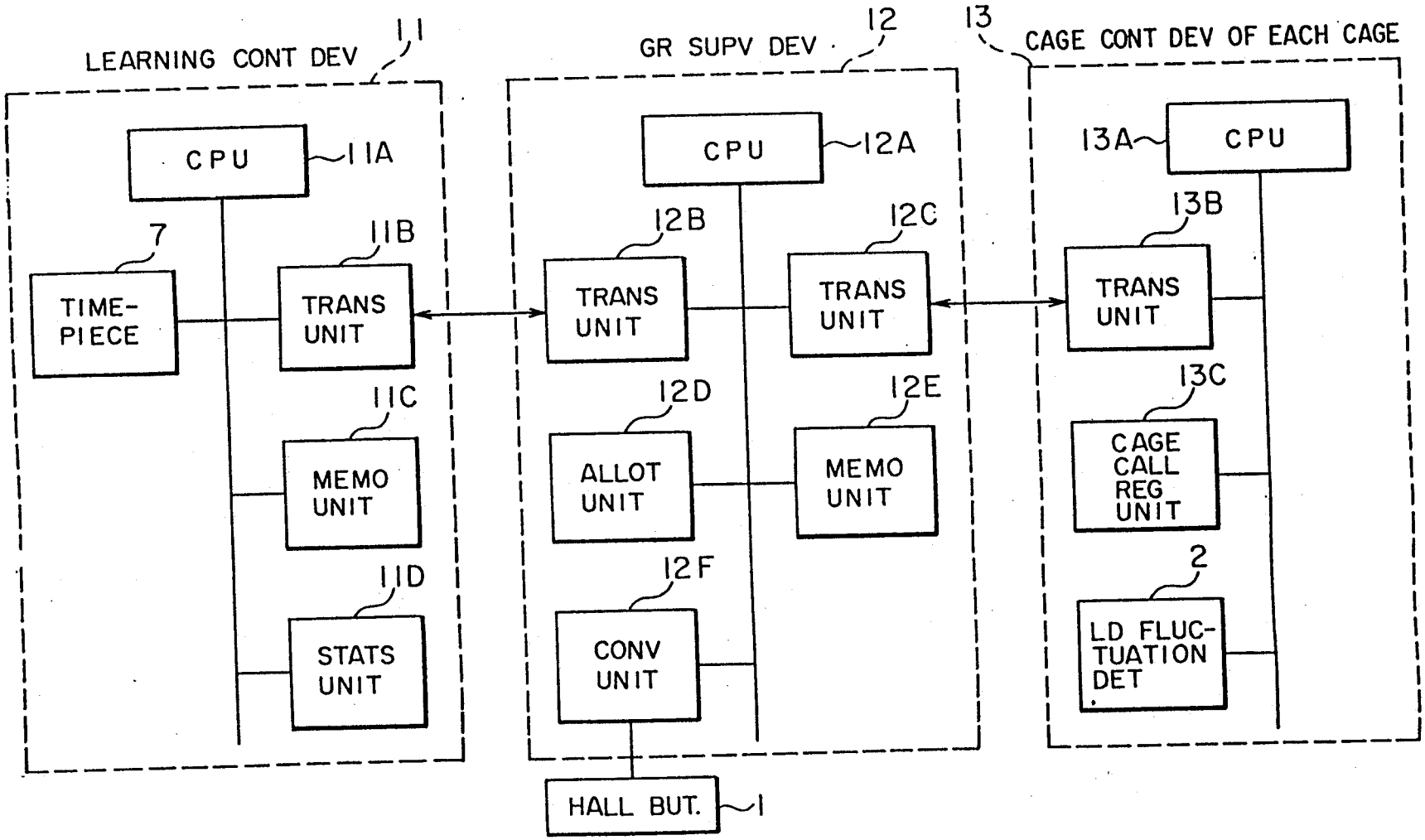
FIG. 2 is a block diagram of the embodiment of this invention.

FIG. 2 is a block circuit diagram of the embodiment shown in FIG. 1. Numeral 11 indicates a learning control device which is constructed of a microcomputer (hereinbelow, abbreviated to "MC"). It includes a central processing unit (hereinbelow, abbreviated to "CPU") 11A, a memory unit 11C configured of a read-only memory (hereinbelow, abbreviated to "ROM") for storing programs and data of fixed values, as well as a random access memory (hereinbelow, abbreviated to "RAM") for temporarily storing data such as calculated results, a transfer unit 11B for transferring data, a statistics unit 11D for executing statistical processing, and the timepiece 7. Numeral 12 indicates a group-supervisory device which is also constructed of an MC, and which similarly includes a CPU 12A, transfer units 12B and 12C, a memory unit 12E, a call allotment unit 12D for allotting calls having occurred to optimum cages, and a conversion unit 12F connected to the hall buttons 1. Numeral 13 indicates a cage control device of each cage, which is also constructed of an MC, and which similarly includes a CPU 13A, a transfer unit 13B, a cage call registration unit 13C, and the load fluctuation detector 2.

Figure 3:
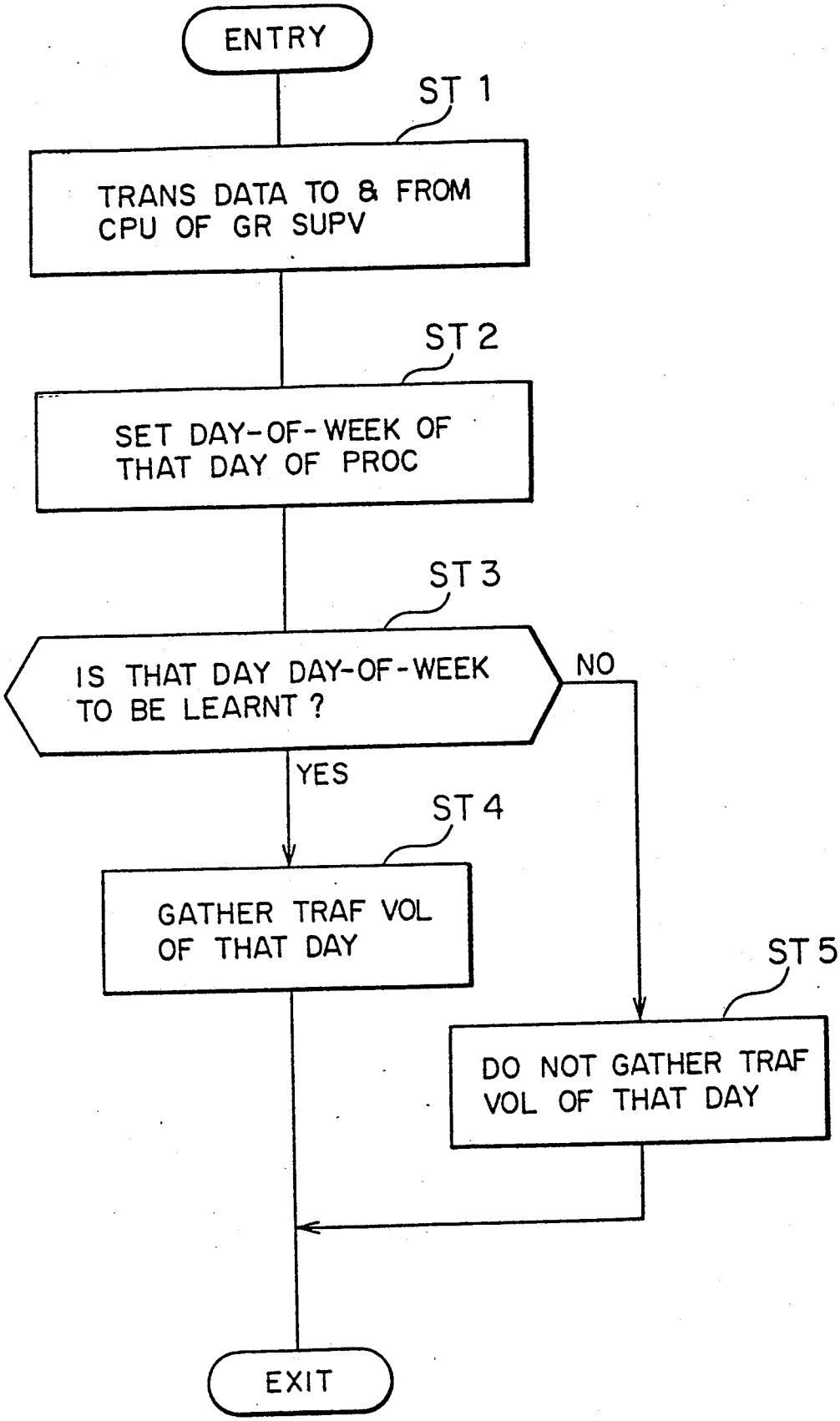
FIGS. 3, 4 and 5 are flow charts each showing the procedure of steps in the embodiment of this invention.

Next, the operation of the group supervision apparatus will be described. FIG. 3 is a flow chart showing the procedure of steps which is executed when an interrupt is applied to the CPU 11A of the learning control device 11 every fixed time interval. At a step ST1, the learning control device 11 sends and receives data to and from the CPU 12A of the group-supervisory device 12. The data items to be sent on this occasion contain traffic parameters (for example, the occurrence rate of cage calls and the predicted value of the number of getting-on persons), while the data items to be received contain quantities on a traffic volume (for example, getting-on and -off loads and the occurrence number of hall calls). A step ST2 sets what day of the week that day of statistical processing is, in accordance with the information of the timepiece 7. At a step ST3, whether or not that day is a day of the week to-be-learnt is decided. Here, holidays (festival days) being weekdays shall not be set as the days of the week to-be-learnt. If that day is the day of the week to-be-learnt, a step ST4 executes the statistical processing in a pattern to which the day of the week of that day belongs, and if not, a step ST5 prevents the execution of the statistical processing. In this way, the traffic volume of the day of the week to have its statistics collected is stored in the memory unit 11C.

Figure 4:
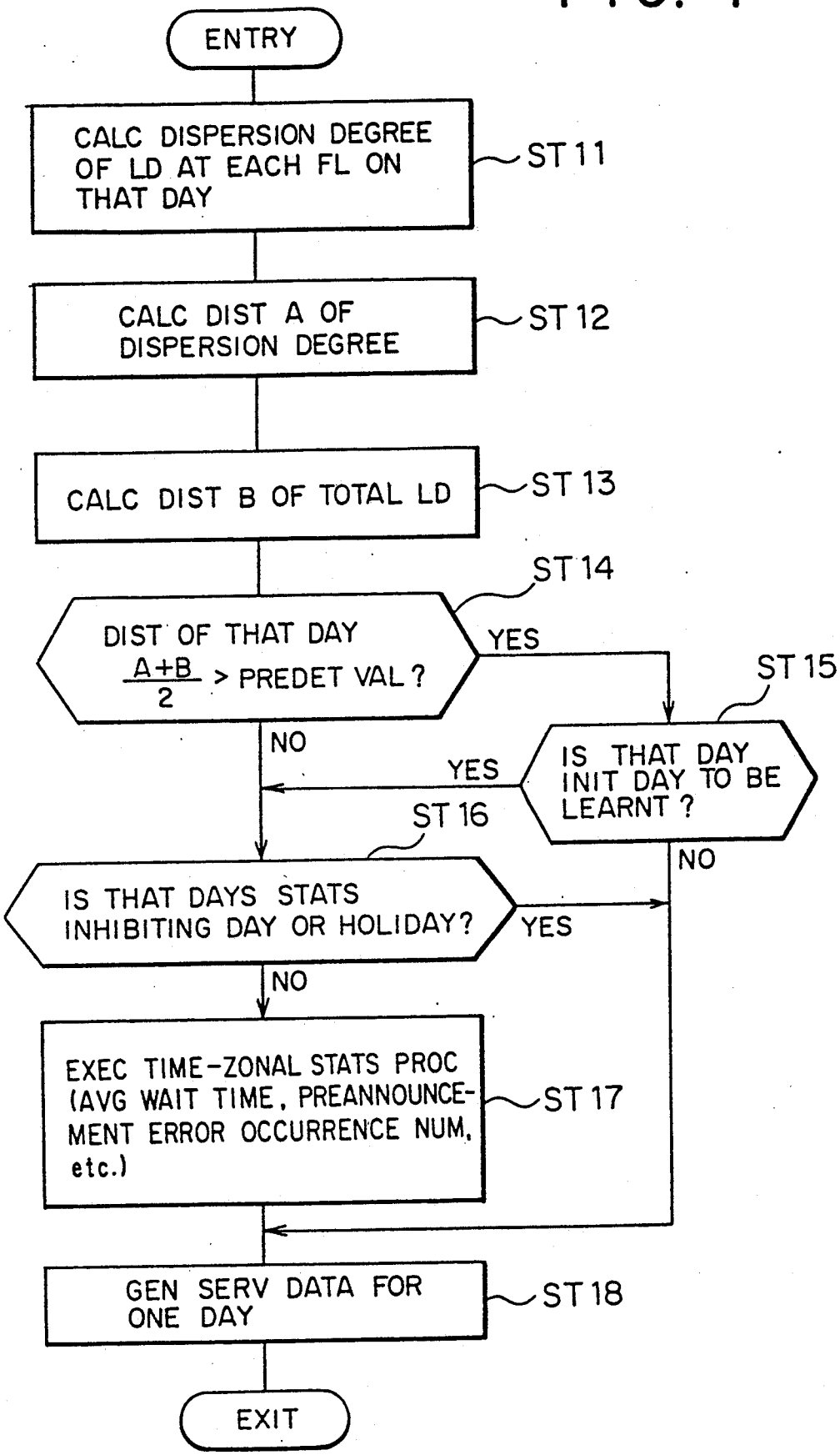

FIG. 4 is a flow chart showing the procedure of steps for deciding whether or not the statistical processing of each time zone is to be executed, and for controlling the statistical processing. The "time zones" here are obtained, for example, by dividing one day by a specified number so that the getting-on and -off loads may become uniform. The statistical processing shall be executed in each of the time zones. At a step ST11, the dispersion degrees of the loads of the respective floors in the particular time zone are computed. The "dispersion degrees" here are the getting-on and -off loads at each floor expressed as values relative to the mean values thereof at each floor. A step ST12 computes the distance A of the dispersion degrees (this distance being the extent to which the actually measured values and statistical values of the respective floors differ). The formula of the computation can be expressed as follows:

$$\left\{ \frac{\sum_{\text{Floors}} \left( \left| \begin{array}{c}\text{Measured}\\ \text{getting-on load}\\ \text{dispersion degree}\end{array} - \begin{array}{c}\text{Statistical}\\ \text{getting-on load}\\ \text{dispersion degree}\end{array} \right| \right)}{\text{Number of Service floors}} + \frac{\sum_{\text{Floors}} \left( \left| \begin{array}{c}\text{Measured}\\ \text{getting-off load}\\ \text{dispersion degree}\end{array} - \begin{array}{c}\text{Statistical}\\ \text{getting-off load}\\ \text{dispersion degree}\end{array} \right| \right)}{\text{Number of Service floors}} \right\} \times \frac{1}{2}$$

A step ST13 computes the distance B of the total loads. The formula of the computation can be expressed as follows:

$$\left\{ \frac{\left| \begin{array}{c}\text{Measured}\\ \text{getting-on total load}\end{array} - \begin{array}{c}\text{Statistical}\\ \text{getting-on total load}\end{array} \right|}{\text{Statistical getting-on total load}} + \frac{\left| \begin{array}{c}\text{Measured}\\ \text{getting-off total load}\end{array} - \begin{array}{c}\text{Statistical}\\ \text{getting-off total load}\end{array} \right|}{\text{Statistical getting-off total load}} \right\} \times \frac{1}{2}$$

The distance (A+B/2) of that day of the statistical processing is obtained at a step ST14, and subject to the obtained value exceeding a predetermined value, whether or not that day is an initial day to-be-learnt is decided at a step ST15. The "initial day to-be-learnt" signifies a day on which at least one week, for example, has not lapsed yet immediately after the start of the statistics. Meantime, data items to have their statistics collected are not sufficiently available yet. A step ST16 decides if that day is a statistics inhibiting day or a holiday (no statistics being taken on holidays), and if not, time-zonal statistical processing is executed at a step ST17. The "statistical processing" here contains, for example, the following:

Wait time statistics

Long wait call statistics

At a step ST18, service data items for one day are generated. The procedure of steps shown in FIG. 4 is executed according to an interrupt applied each time a new time zone is reached.

Figure 5:
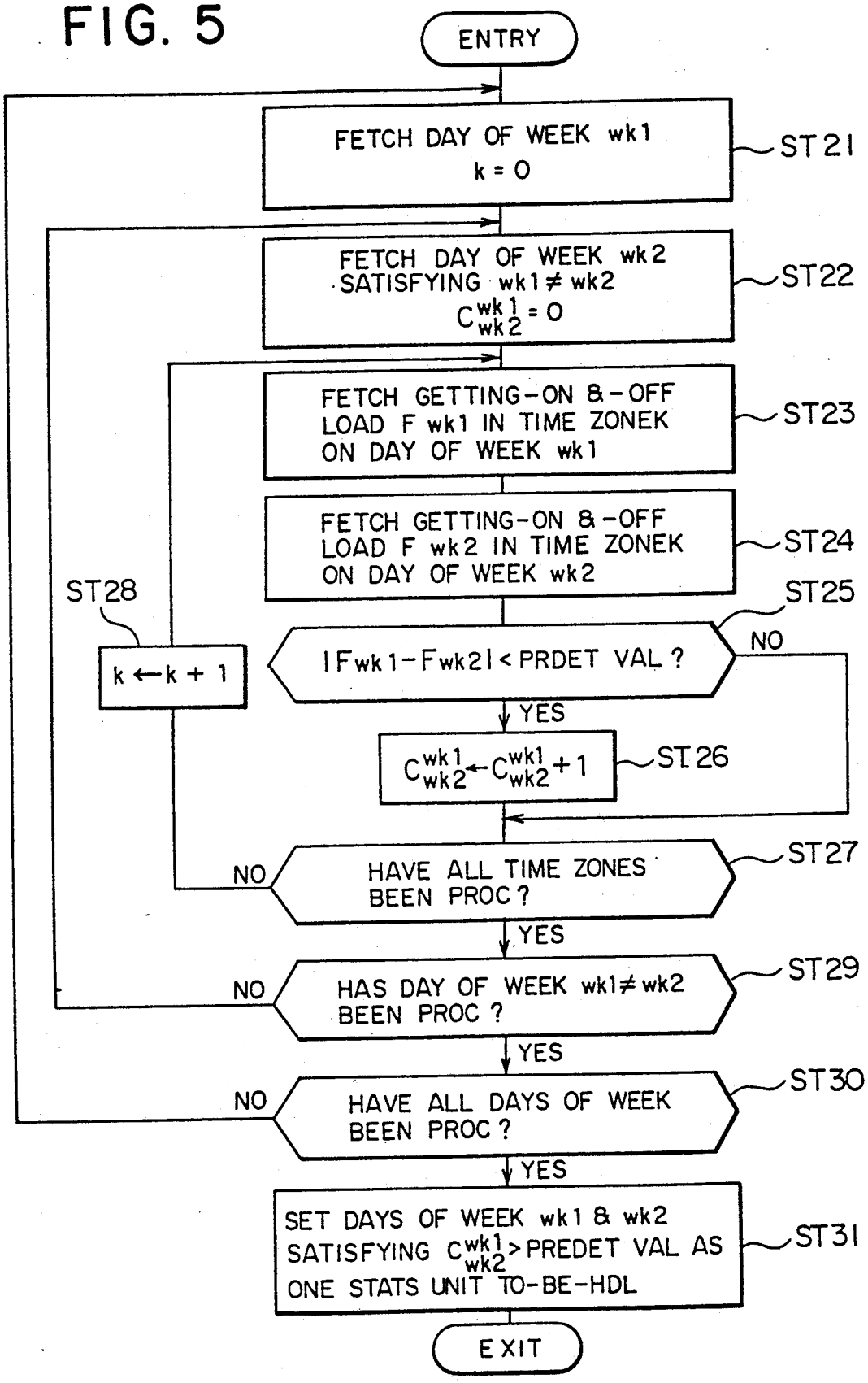

FIG. 5 is a flow chart showing the procedure of steps for deciding a statistical unit to-be-handled (in which a plurality of days of the week are collectively handled). By way of example, this program is called out once a week so as to execute the decision processing. Here, only the processing on weekdays (Monday–Friday) shall be executed with the traffic patterns of Saturday and Sunday regarded as being obviously different from those of the other days of the week.

At a step ST21, a day of the week wk1 is fetched. At a step ST22, another day of the week WK2 different from the day of the week wk1 is fetched. The number of time zones in which the statistical magnitudes of the days of the week wk1 and wk2 are similar is put as $$C_{wk2}^{wk1} = 0.$$

The quantity $$C_{wk2}^{wk1}$$

is the number of the time zones in which, for example, the difference of the total getting-on and -off loads becomes within a predetermined value between the days of the week WK1 and WK2. If $$C_{Tues.}^{Mon.} = 10$$

holds, it is meant that the number of the time zones in which the difference of statistical data falls within a predetermined value between Monday and Tuesday is 10. Naturally, this number becomes smaller than the divisional number of the time zones. Since the individual days are divided by the identical number, the respective corresponding time zones of the same number are compared with each other according to the following method:

At a step ST23, a getting-on and -off load $F_{wk1}$ in the time zone k of the day of the week wk1 is fetched. At a step ST24, a getting-on and -off load $F_{wk2}$ in the time zone k of the day of the week wk2 is fetched. A step ST25 decides if the difference of the loads $F_{wk1}$ and $F_{wk2}$ is less than a predetermined value, and if so, a step ST26 increases the count number $$C_{wk2}^{wk1}$$

by one.

Whether all the time zones have been compared, is decided at a step SST27 (and a step ST28), and whether all the days of the week to be handled have been compared is decided at steps ST29 and ST30. Thus, the processing is repeated until the ends of the comparisons are decided. The decision for selecting a group of time zones as the statistical unit to-be-handled can be rendered by the above steps.

Figure 7:
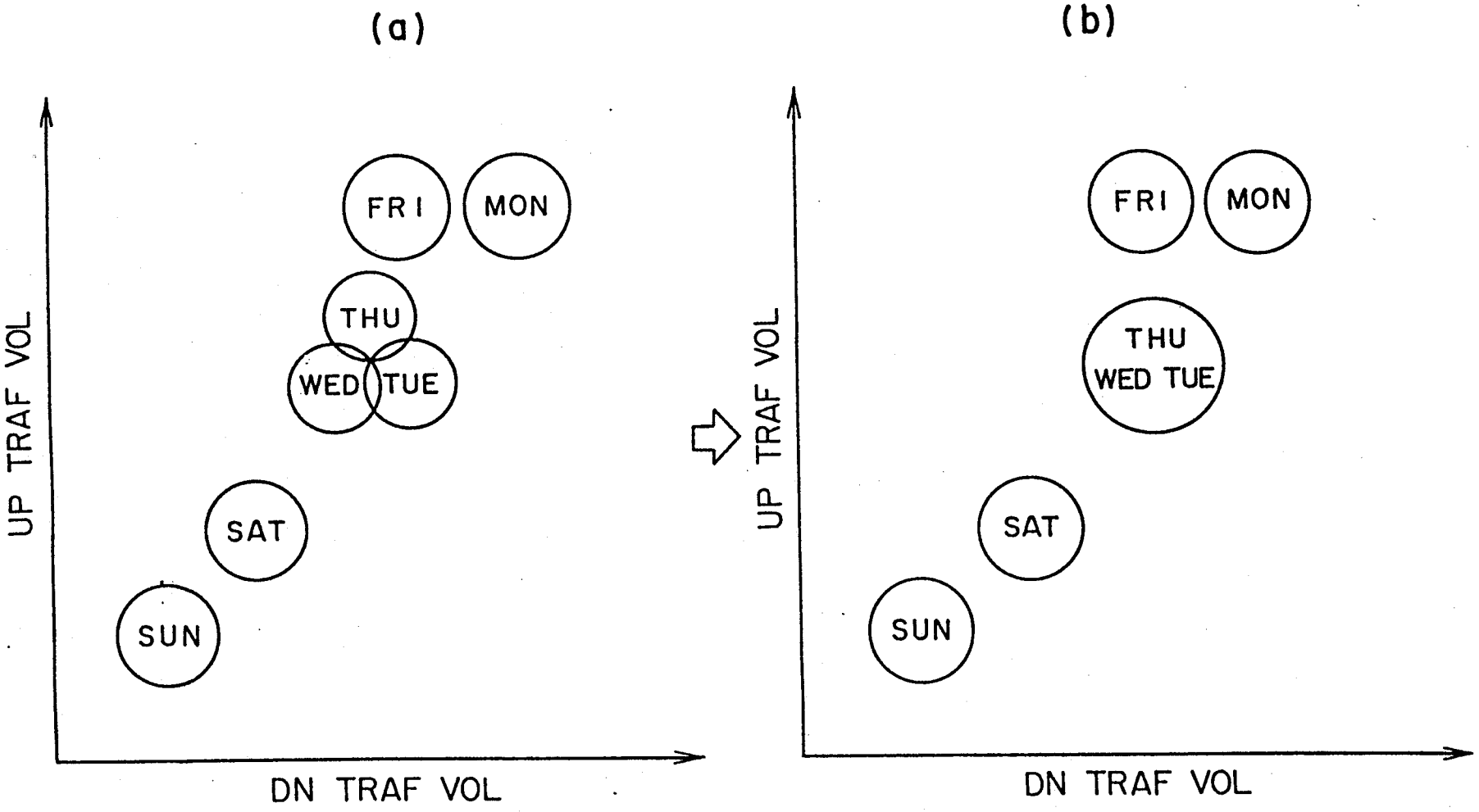
Figure 8:
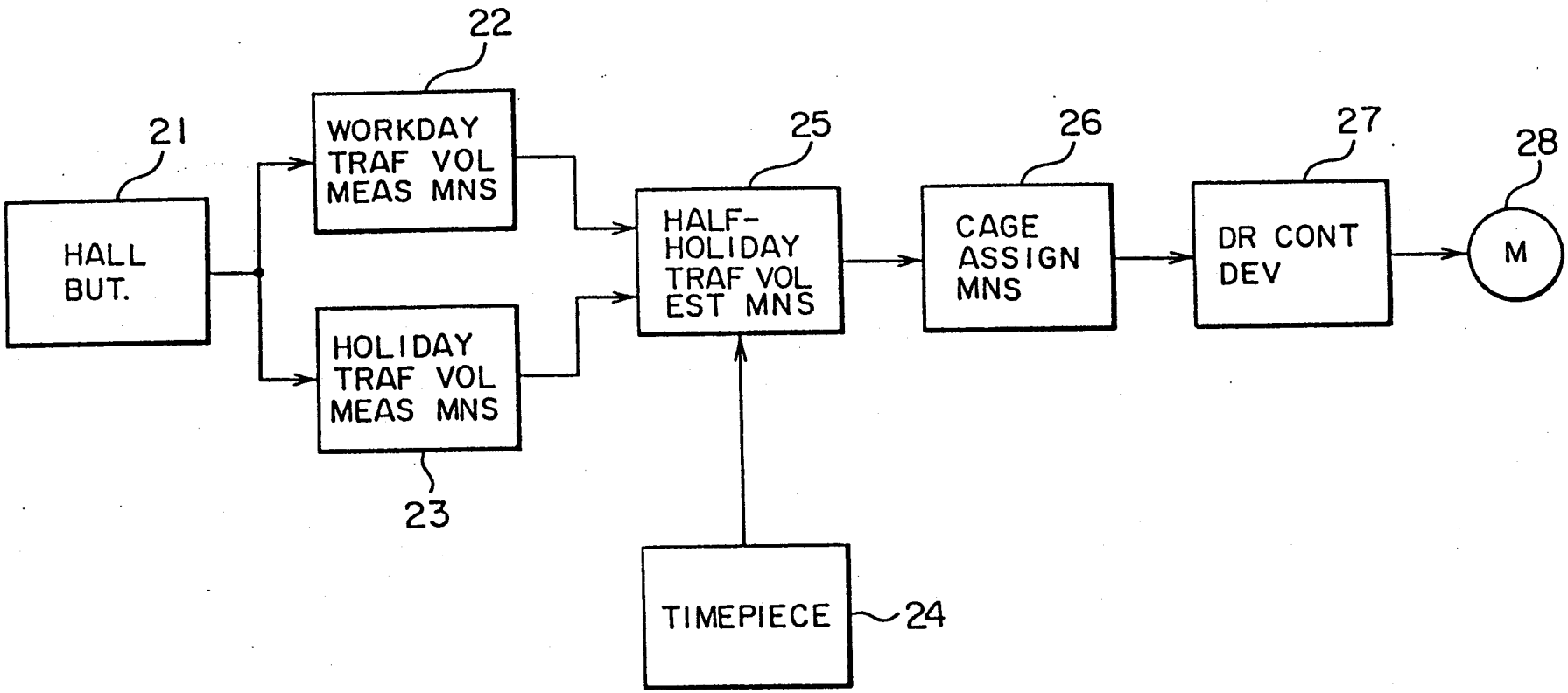
FIG. 8 PRIOR ART
FIG. 8 is an arrangement diagram of a prior-art example.

At the final step ST31 in FIG. 5, the days of the week wk1 and wk2 as to which the count $$C_{wk2}^{wk1}$$

exceeds the predetermined value are set as the collective statistical unit to-be-handled. That is, the group of time zones being the plurality of days of the week, as to which the number of the time zones exhibiting small traffic volume differences between the respective days of the week exceeds the predetermined value in accordance with the count number $$C_{wk2}^{wk1}$$

evaluated by the procedure of steps shown in FIG. 5, are registered in a single pattern as the days of the week whose traffic patterns are similar. This operation of the registration will be explained on an example of a classification diagram illustrated in FIG. 6. Pattern-3 has been decided to have a large number of similar time zones, with the result that the traffic states of one week can be predicted with five patterns. Thus, Tuesday, Wednesday and Thursday are deemed to exhibit the identical traffic pattern as shown in FIGS. 7(*a*) and 7(*b*). Thenceforth, these three days of the week have their statistics handled as one unit. Incidentally, an UP traffic volume in each of FIGS. 7(*a*) and 7(*b*) represents the total getting-on load of the elevator system in the UP direction thereof for one day, while a DOWN traffic volume represents the total getting-on load in the DOWN direction for one day.

For the sake of brevity, the two-dimensional aspect of the UP/DOWN traffic volumes is referred to here. In actuality, however, statistics are collected in more dimensions including main-floor traffic volumes and forenoon and afternoon traffic volumes, whereby the traffic states of the building are predicted.

Even on the plurality of days of the week which have once been regarded as exhibiting the identical traffic pattern, their traffic patterns might fluctuate due to, for example, the change of tenants in the building. On such an occasion, the days of the week are recombined according to the procedure of steps described with reference to FIG. 5. In the above, the days of the week, namely, one week have been exemplified as one cycle to-be-handled. Needless to say, however, the example is not restrictive, and one month may well be set as one cycle by handling the days of 1st–30th by way of example.

As described above, according to this invention, days exhibiting similar traffic states have their information items gathered and processed as an identical unit. Therefore, the invention brings forth the effects that saving in the storage capacity of a computer can be attained and that statistical results of enhanced precision are obtained.

What is claimed is:

1. A group supervision apparatus for an elevator system wherein information items on elevator traffic states are gathered and future traffic states are predicted on the basis of the gathered traffic state information items, comprising:

handling unit decision means for grouping days having like traffic information into a handling unit where said handling unit decision means includes:

means for gathering traffic state information items of the elevator system for selected days over a predetermined means for separating each day into a number of preset time zones and comparing information contained in the time zones of one day with information contained in corresponding time zones of another day, and means for designating days which exhibit similar traffic states of small mutual differences as a handling unit; and means for statistically processing the traffic state information items of each time zone of each selected day where the days comprising a handling unit have their statistics processed as a single unit.

2. A group supervision apparatus for an elevator according to claim 1 wherein the small mutual differences fall within a predetermined value.

3. A group supervision apparatus for an elevator according to claim 1 including means for recombining days of a week every cycle of a predetermined number of days as traffic state information items fluctuate.

4. A group supervision method for an elevator system wherein information items on elevator traffic states are gathered and future traffic states are predicted on the basis of the gathered traffic state information items, comprising the steps of:

(a) gathering traffic state information items of the elevator system for selected days over a predetermined term;

(b) separating each day into a number of preset time zones each containing traffic state information;

(c) comparing traffic state information items contained in time zones of one day with information contained in corresponding time zones of another day and deciding whether similar traffic states of small mutual differences are processed in common as to respective days;

(d) grouping days decided mutually similar together as a handling unit; and (e) statistically processing traffic state information items of each time zone of each selected day, where the days comprising the handling unit have their statistics processed as a single unit.

5. A group supervision method for an elevator system according to claim 4 wherein the small mutual differences fall within a predetermined value.

6. A group supervision method for an elevator system according to claim 4 further including the step of recombining days of a week every cycle of a predetermined number of days as traffic state information items fluctuate.

* * * * *

UNITED STATES PATENT AND TRADEMARK OFFICE

CERTIFICATE OF CORRECTION

PATENT NO. : 5,031,728

DATED : July 16, 1991

INVENTOR(S) : Masaaki Amano

It is certified that error appears in the above-identified patent and that said Letters Patent is hereby corrected as shown below:

Column 6, line 46, after "predetermined" insert --term--.

Column 7, line 14, change "processed" to --possessed--.

Signed and Sealed this

Second Day of March, 1993

*Attest:*

STEPHEN G. KUNIN

*Attesting Officer*

*Acting Commissioner of Patents and Trademarks*